US009890498B2

(12) United States Patent
Setoguchi et al.

(10) Patent No.: US 9,890,498 B2
(45) Date of Patent: Feb. 13, 2018

(54) HYDROPHILIC SHEET AND PROCESS FOR PRODUCING THE SAME

(71) Applicant: Nippon Valqua Industries, Ltd., Tokyo (JP)

(72) Inventors: Yoshihiro Setoguchi, Tokyo (JP); Manabu Motoori, Tokyo (JP); Tomohiro Nakagawa, Tokyo (JP)

(73) Assignee: Nippon Valqua Industries, Ltd., Tokyo (JP)

( * ) Notice: Subject to any disclaimer, the term of this patent is extended or adjusted under 35 U.S.C. 154(b) by 374 days.

(21) Appl. No.: 14/417,856

(22) PCT Filed: Jul. 24, 2013

(86) PCT No.: PCT/JP2013/070043

§ 371 (c)(1),
(2) Date: Jan. 28, 2015

(87) PCT Pub. No.: WO2014/021167

PCT Pub. Date: Feb. 6, 2014

(65) Prior Publication Data

US 2015/0252522 A1 Sep. 10, 2015

(30) Foreign Application Priority Data

Jul. 31, 2012 (JP) ..... 2012-169843

(51) Int. Cl.
*D06M 15/333* (2006.01)
*D01D 5/00* (2006.01)
(Continued)

(52) U.S. Cl.
CPC ..... *D06M 15/333* (2013.01); *D01D 5/0007* (2013.01); *D04H 1/4318* (2013.01);
(Continued)

(58) Field of Classification Search
CPC ..... D06M 5/333; D06M 2101/22; D06M 2400/01; D01D 5/0007; D04H 1/4318;
(Continued)

(56) References Cited

U.S. PATENT DOCUMENTS 5,009,971 A * 4/1991 Johnson ..... H01M 2/162 428/331
5,476,589 A * 12/1995 Bacino ..... B01D 39/1692 210/500.36
(Continued)

FOREIGN PATENT DOCUMENTS

CN 1509804 A 7/2004
CN 101838934 A 9/2010
(Continued)

*Primary Examiner* — Jeremy R Pierce
(74) *Attorney, Agent, or Firm* — The Webb Law Firm

(57) ABSTRACT

Provided is a hydrophilic fluororesin sheet having significantly improved properties such as filtering performance which includes primary fibers and secondary fibers having a smaller fiber diameter than a fiber diameter of the primary fibers, the secondary fibers crosslinking in each of the primary fibers and/or crosslinking between different primary fibers in such a manner that no knots are formed at crosslinking points, the primary fibers and the secondary fibers including fluororesin fibers including polytetrafluoroethylene [PTFE], wherein a surface of the sheet to which hydrophilization treatment has been applied.

15 Claims, 3 Drawing Sheets

(51) Int. Cl.
*D04H 1/4318* (2012.01)
*D04H 1/728* (2012.01)
*D06M 101/22* (2006.01)

(52) U.S. Cl.
CPC ..... *D04H 1/728* (2013.01); *D06M 2101/22* (2013.01); *D06M 2400/01* (2013.01); *D10B 2321/042* (2013.01); *D10B 2401/022* (2013.01); *Y10T 428/268* (2015.01)

(58) Field of Classification Search
CPC ..... D04H 1/728; Y10T 428/268; D10B 2321/042; D10B 2401/022
See application file for complete search history.

(56) References Cited

U.S. PATENT DOCUMENTS

2008/0122142 A1 5/2008 Kim et al.
2009/0127187 A1 5/2009 Hokazono et al.
2009/0189319 A1* 7/2009 Kim ..... D01D 5/0076 264/484
2010/0193999 A1 8/2010 Anneaux et al.
2011/0000846 A1 1/2011 Ishizuka et al.
2011/0052900 A1* 3/2011 Uno ..... B01D 61/147 428/304.4
2012/0208068 A1* 8/2012 Fukunaga ..... H01M 2/145 429/149
2012/0312488 A1* 12/2012 Gupta ..... D04H 1/42 162/145

FOREIGN PATENT DOCUMENTS

JP 42-13560 8/1942
JP 04-353534 12/1992
JP 08-283447 10/1996
JP 09-296368 11/1997
JP 2001-327816 11/2001
JP 2002-348773 12/2002
JP 2004-154652 6/2004
JP 2005-097753 4/2005
JP 2005-159283 6/2005
JP 2007-518891 A 7/2007
JP 2008-519175 A 6/2008
JP 2009-024293 2/2009
JP 2009-057655 3/2009
JP 2009-097112 5/2009
JP 2009-119412 A 6/2009
JP 2011-11194 A 1/2011
JP 2013-139661 7/2013
WO 20131084760 A1 6/2013

* cited by examiner

[Fig. 1]
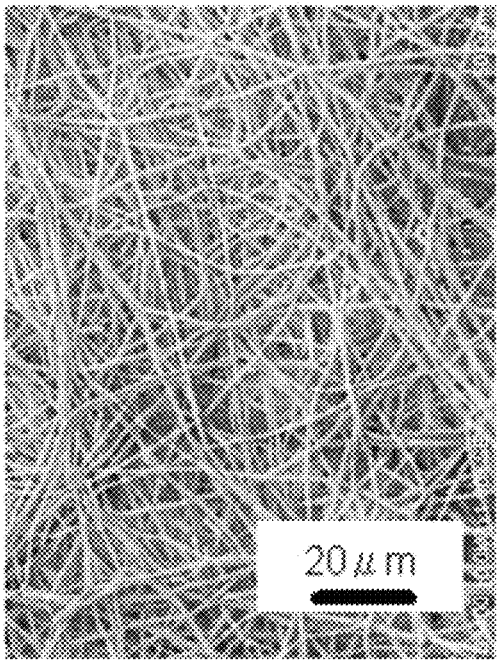
[Fig. 2]
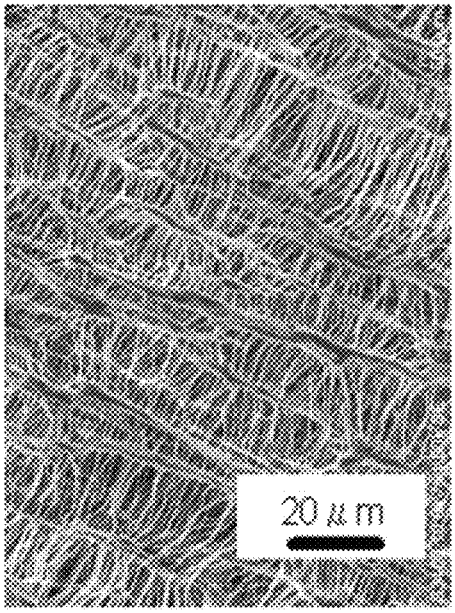

[Fig. 3]
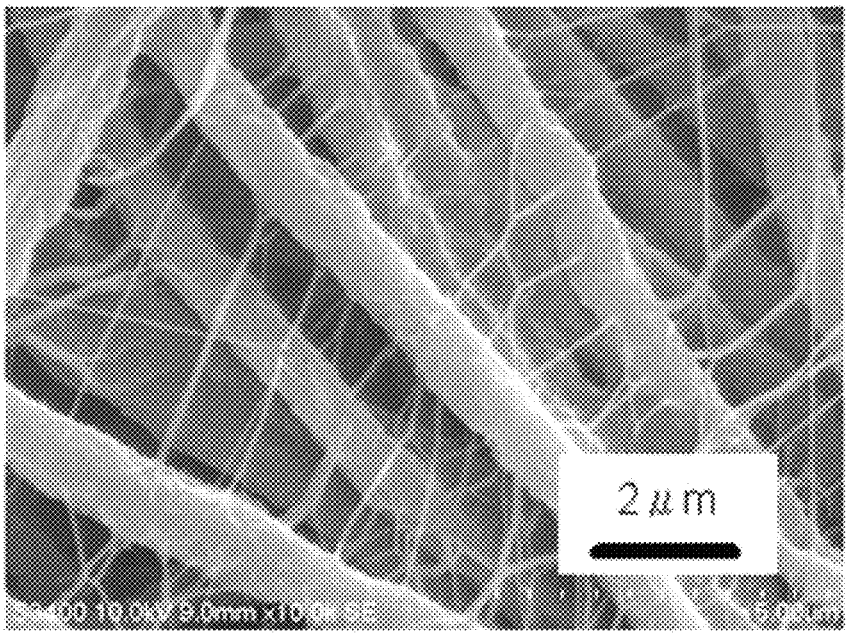

Fig. 4
| | Production Example 1 | Production Example 2 | Production Example 3 | Comp. Production Example 1 | Comp. Production Example 2 |
|---|---|---|---|---|---|
| SEM photograph (magnification: 5000) | 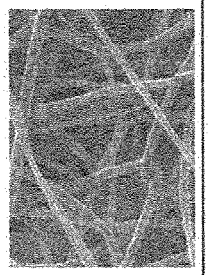 | 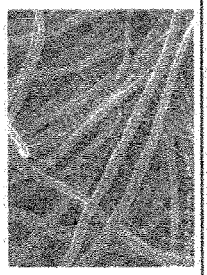 | 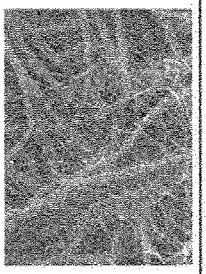 | 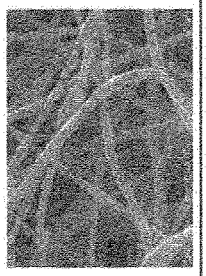 | 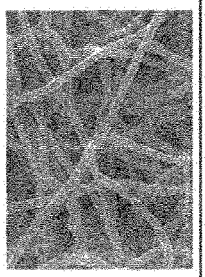 |
| Secondary fibers | Present | Present | Present | Absent | Absent |

HYDROPHILIC SHEET AND PROCESS FOR PRODUCING THE SAME

CROSS-REFERENCE TO RELATED APPLICATIONS

This application is the United States national phase of International Application No. PCT/JP2013/070043 filed Jul. 24, 2013, and claims priority to Japanese Patent Application No. 2012-169843 filed Jul. 31, 2012, the disclosures of which are hereby incorporated in their entirety by reference.

TECHNICAL FIELD

The present invention relates to a hydrophilic sheet obtained by applying hydrophilization treatment to a surface of a fluororesin sheet obtained through specific steps using fibers comprising polytetrafluoroethylene (PTFE) alone or fibers comprising PTFE and a fluororesin other than PTFE (the fibers being also referred to collectively as "fluororesin fibers"), and a process for producing the same. In particular, the present invention relates to a hydrophilic sheet obtained by applying hydrophilization treatment to a surface of a fluororesin sheet comprising fluororesin fibers comprising relatively thicker fibers (primary fibers) and thinner fibers (secondary fibers), the secondary fibers bridging different primary fibers (or different portions of each of the primary fibers), and a process for producing the same.

BACKGROUND ART

PTFE has excellent chemical resistance, heat resistance, and electrical insulating properties as well as properties such as self-lubricating properties and non-adhesive properties, and thus has been widely used in the fields of daily life as well as the industrial field. On the other hand, these properties mean difficulty in processing of PTFE. In other words, PTFE, though classified as a thermoplastic resin, is different from common plastics, such as polyethylene and vinyl chloride resin, and exhibits no flowability even when heated to 327° C. or higher where PTFE is in a non-crystalline state, and thus processes such as screw extrusion, injection molding, and roll forming in a heated state cannot be applied. Furthermore, even if one tries to prepare a PTFE solution and apply it to the surface of a substrate or coat the substrate, it is difficult to prepare the PTFE solution because there is no appropriate solvent, and even if one tries to bond a PTFE formed product to a target substrate, an adhesive that allows for a direct bond has not been discovered yet. In addition, heat fusion of PTFE and PTFE or PTFE and other resins, though possible, requires a high pressure, and PTFE cannot be easily bonded unlike other plastics.

Previously developed methods of processing PTFE are similar to methods of powder metallurgy. Examples include press-forming PTFE at about room temperature and sintering the press-formed product by heating it to 327° C. or higher; further forming this (sintered body), for example, by machine cutting or heat coining; extrusion-molding a mixture of PTFE powder and a liquid lubricant using a ram-type extruder, and then drying and sintering the extrudate for production of pipes and tubes or wire coating; and coating a substrate with an aqueous suspension of PTFE resin, for example, by application or dipping, and then sintering the coated substrate.

When PTFE is processed into an ultrafine fiber (also referred to as "nanofiber"), electrospinning (also referred to as "electrodeposition" or "electrostatic spinning") as disclosed in Patent Documents 1 to 4 and 7 to 10 or stretching methods as disclosed in Patent Documents 5 and 6 can be used.

Patent Document 1 discloses a method of producing a nanofiber as shown in FIG. 1 by spinning from a PTFE dispersion containing polyethylene oxide (PEO) by electrospinning, and then removing PEO simultaneously with sintering. According to the production method disclosed in Patent Document 1, fiber diameter, basis weight, and the like can be controlled by selecting solution conditions and spinning conditions, and fibers can be oriented by using a special apparatus. Further, materials can be easily composited, and nanofibers having a high aspect ratio and a uniform diameter can be produced. However, the fiber diameter is about 500 nm at a minimum.

Patent Document 2 discloses a nonwoven fabric in which microfibers with a diameter of 0.001 to 1 μm formed by electrostatic spinning and ultrafine fibers with a diameter of 2 to 25 μm formed by melt blowing coexist, and polyvinylidene fluoride (PVDF) is given as an example of a fluorine resin constituting the microfibers formed by electrostatic spinning (paragraph [0019]).

Patent Document 3 discloses an apparatus that is able to prevent interference between adjacent nozzles and, in addition, to deposit different polymer solutions simultaneously in a multi-nozzle electrodeposition method (electrospinning method). In a polymer web produced using this apparatus, fibers are not joined together, although they may be entangled with each other.

Patent Document 4 discloses a production method comprising the step of feeding a polymer solution obtained by dissolving a polymer in a solvent into one rotary container at the circumference of which a plurality of small holes with different diameters are formed or a plurality of rotary containers that are concentrically united, and the step of electrifying the polymer solution that flows out of the small holes upon rotation of the rotary container and stretching the polymer solution that flows out of the small holes by means of centrifugal force and electrostatic explosion due to evaporation of the solvent, thereby forming a nanofiber comprising the polymer. According to this production method, a polymer web can be produced which is formed by mixing or laminating various nanofibers with different physical properties and depositing the mixture or laminate, but there are no embodiments where the fibers with different physical properties are joined together.

Patent Document 5 discloses a method of producing a porous structure (FIG. 2), in which an unsintered tetrafluoroethylene resin (i.e., PTFE) mixture containing a liquid lubricant is formed by extrusion and/or rolling, stretched in the unsintered state in at least one direction, and then heated to about 327° C. or higher. The unsintered tetrafluoroethylene resin tends to form a fine fibrous structure when subjected to shear forces: e.g., when extruded though a die during the extrusion process, when calendered under a roll, or when vigorously stirred. The resin containing a liquid lubricant is more easily fibrillized (page 2, right column, lines 9 to 13). As shown in FIG. 2, thick massive nodes (also referred to as "knots") and thin fibrous fibrils coexist, the nodes having a fiber diameter of several micrometers to 1 μm, the fibrils having a fiber diameter of about 100 nm. According to the production method disclosed in Patent Document 5, fibers can be oriented by stretching and heating.

Patent Document 6 discloses a polytetrafluoroethylene porous body having a fine fibrous structure comprising fibers and knots connected to each other by the fibers, and this PTFE porous body has reticularly and three-dimensionally continuous short-fiber sections. According to the method of producing the PTFE porous body in Patent Document 6, unsintered PTFE powder and a liquid lubricant are mixed first and formed into a desired shape, for example, by extruding or rolling. The formed product obtained, from which the liquid lubricant may or may not be removed, is then stretched in at least one direction to form the PTFE porous body having a fine fibrous structure comprising fibers and knots connected to each other by the fibers.

Patent Document 7 discloses a method of producing a fiber sheet comprising uniaxially reoriented fibers by forming a fiber assembly from a spinning solution containing polyvinylidene fluoride (PVDF), polyvinylidene fluoride-hexafluoropropylene copolymer (paragraph [0016]), or the like by electrostatic spinning, and then stretching the fiber assembly in one direction.

Patent Document 8 discloses a method of producing a continuous filament composed of nanofibers with a diameter of, preferably, 500 nm or less through a continuous process using an electrospinning technique. Poly (ϵ-caprolactone) polymer (Example 1), polyurethane resin (Example 2), and nylon 6-resin (Example 3) are given as specific examples of polymers constituting the nanofibers.

Patent Document 9 discloses a method of producing a continuous filament composed of nanofibers with a diameter of, preferably, 500 nm or less from a polymer spinning solution containing a nylon resin (e.g., Example 1) through a continuous process using an electrostatic spinning technique.

Patent Document 10 discloses a wet-laid nonwoven fabric, wherein a wet-laid fiber web comprising a wholly aromatic polyamide fiber having fibrils and a polyester resin fiber is irradiated with infrared rays under no pressure, whereby the wholly aromatic polyamide fiber is fixed by the polyester resin solidified in a non-fibrous state at its fiber intersection. There is described that PTFE can be used in place of the wholly aromatic polyamide fiber (paragraph [0032]), but this is not specifically demonstrated in Examples or anywhere else.

Anyway, for fluororesin fiber sheets comprising fluororesin fibers, there is room for further improvement in sheet-like filters having both excellent properties (e.g., water repellency, heat resistance, chemical resistance, and sound permeability) of PTFE and a high specific surface area.

By the way, there is proposed the use of a hydrophilized microporous membrane comprising a crystalline polymer including PTFE as a filter for filtration or sterilization (Patent Document 11).

Commonly known methods of hydrophilization include irradiation with ultraviolet laser or ArF laser and chemical etching with a metallic sodium-naphthalene complex (Patent Document 12).

Further, in Patent Documents 11 and 13, hydrophilicity of a membrane is improved by employing a hydrophilic treatment in which the membrane is coated with polyvinyl alcohol (PVA), which is then crosslinked using an epoxy compound.

However, there remains room for further improvement in filtering performance of the filters for filtration disclosed in Patent Documents 11 to 13.

CITATION LIST

Patent Documents

[Patent Document 1] US-2010/0193999 A1
[Patent Document 2] JP-A-2009-057655
[Patent Document 3] JP-A-2009-024293
[Patent Document 4] JP-A-2009-097112
[Patent Document 5] JP-B-42-13560
[Patent Document 6] JP-A-04-353534
[Patent Document 7] JP-A-2005-097753
[Patent Document 8] JP-A-2007-518891
[Patent Document 9] JP-A-2008-519175
[Patent Document 10] JP-A-2005-159283
[Patent Document 11] JP-A-2011-11194
[Patent Document 12] JP-A-2009-119412
[Patent Document 13] JP-A-08-283447

SUMMARY OF THE INVENTION

It is an object of the present invention to provide a hydrophilic sheet which is obtained by applying hydrophilization treatment to a fluororesin sheet containing PTFE fibers and which has significantly improved filtering performance for precise filtration of gas or liquid as compared to conventional ones.

The present inventors pressed the fluororesin fiber sheet made of PTFE fibers that were obtained by the method described in Patent Document 1 in an electric furnace at 360° C. while causing stress in direction perpendicular to the pressing and thereafter taken it out from the electric furnace. Then, they observed surfaces of the sheet at ordinary temperature and under ordinary pressure by using a scanning electron microscope [SEM]. As a result, as shown in FIG. 3, they not just observed thicker fibers (primary fibers) being the original PTFE fibers existent in the fluororesin fiber sheet (a0) subjected to the heating and pressure application treatments, but also identified the generation of thinner fibers (secondary fibers), which were not seen in the original fluororesin fiber sheet (a0) but were seen in a fluororesin sheet (a1) having undergone the heating and pressure application treatments. They also found out that in the fluororesin sheet (a1) having undergone the heating and pressure application treatments, the thicker fibers (primary fibers) were crosslinked to each other by the newly-formed thinner fibers (secondary fibers) without knots (or nodes) and parts of the thinner fibers were crosslinked to each other without knots (or nodes).

Furthermore, the present inventors have found out that coating the surface of the fluororesin sheet (a1) thus obtained with a hydrophilic group-having compound which was followed by crosslinking the hydrophilic group-having the compound considerably improved filtering performance for precise filtration not just of gas but also of liquid. Based on these findings, the present invention has been perfected.

Specifically, the hydrophilic sheet of the present invention is obtained by applying hydrophilization treatment to a fluororesin sheet, wherein a surface of the hydrophilic sheet has hydrophilicity such that a water contact angle is 90° or less, and wherein the fluororesin sheet comprises primary fibers and secondary fibers having a smaller fiber diameter than a fiber diameter of the primary fibers, the secondary fibers crosslinking in each of the primary fibers and/or crosslinking between different primary fibers in such a manner that no knots are formed at crosslinking points, the primary fibers and the secondary fibers comprising fluororesin fibers comprising polytetrafluoroethylene [PTFE].

It is preferred that the primary fibers have a fiber diameter of from 100 nm to 50 μm and the secondary fibers have a fiber diameter of from 10 nm to less than 1 μm, in terms of e.g., strength, breathability and filtering performance.

It is preferred that the fluororesin fiber be made of PTFE alone in view of properties (such as water repellency, heat resistance, chemical resistance and sound permeability) as well as performance (filtering performance) of the resultant fluororesin sheet. In the present invention, the fluororesin fibers may comprise, in addition to PTFE, one kind of or two or more kinds of "other fluororesin(s)" including tetrafluoroethylene-perfluoroalkyl vinyl ether copolymer [PFA], tetrafluoroethylene-hexafluoropropylene copolymer [FEP], tetrafluoroethylene-hexafluoropropylene-perfluoroalkyl vinyl ether copolymer [EPE], poly(chlorotrifluoroethylene) [PCTFE], tetrafluoroethylene-ethylene copolymer [ETFE], low melting point ethylene-tetrafluoroethylene copolymer, ethylene-chlorotrifluoroethylene copolymer [ECTFE], polyvinylidene fluoride [PVDF], fluoroethylene-vinyl ether copolymer [FEVE] and tetrafluoroethylene-perfluorodioxole copolymer [TFEPD]. Provided that PTFE and the fluororesin(s) described above total 100 wt %, when the fluororesin(s) is contained at more than 0 wt % and less than 50 wt %, properties such as heat resistance and durability are reduced to some degree, but processability and controllability of fiber diameters tend to be enhanced, as compared with when PTFE alone is contained.

The hydrophilization treatment is preferably a coating treatment using a hydrophilic group-having compound.

The hydrophilic group-having compound is at least one compound selected from the group consisting of hydroxyl group-containing compounds, carboxylic acid group-containing compounds, sulfonic acid group-containing compounds, ether group-containing compounds, epoxy group-containing compounds and amino group-containing compounds. In particular, polyvinyl alcohol [PVA] is preferred.

A process for producing the hydrophilic sheet of the present invention comprises a secondary fiber formation step of causing stress in at least two directions in the fluororesin fiber sheet made of fluororesin fibers, while heating the sheet, to form the secondary fibers thereby obtaining a fluororesin sheet; and a hydrophilization step of applying hydrophilization treatment to a surface of the fluororesin sheet to obtain the hydrophilic sheet.

Particularly when the fluororesin fiber sheet (a0), which comprises fibers made of PTFE alone, is used, it is preferred that a temperature under the heating (e.g., in an electric furnace) generally range from 180° C. to 400° C., and that the stress be caused by a compressive load ranging from 0.01 kg/cm$^2$ to 10 kg/cm$^2$ and a shearing load in terms of enabling the secondary fibers with a uniform desired thickness to bridge the primary fibers, preventing knots from occurring at crosslinking (bonding) positions between the primary fibers and the secondary fibers, and consequently achieving superior properties and performance described above.

On the other hand, when the fluororesin fiber sheet (b0), which comprises fibers containing PTFE and fluororesin(s) different therefrom, is used, a preferred temperature under the heating (for example, in an electric furnace) is the one which does not lead to the fibers being completely molten to lose fiber-shape. It is preferred that the temperature generally range, for example, from 150° C. to 360° C., and it is preferred that stress be caused by applying a compressive load ranging from 0.01 kg/cm$^2$ to 20 kg/cm$^2$ and a shearing load. This is preferred in terms of e.g., fiber-shape stability.

The hydrophilization step preferably includes a step (v) of immersing the fluororesin sheet in a solution of the hydrophilic group-having compound to coat the fluororesin sheet with the compound, and a step (vi) of crosslinking the compound having coated the fluororesin sheet obtained in the step (v).

Effects of the Invention

The fluororesin sheet used in the present invention comprises fibers made of PTFE alone (PTFE: 100 wt %) or from fibers containing at least PTFE (PTFE content: generally 50 wt % or more and less than 100 wt %, preferably 80 wt % or more and less than 100 wt %), thus exhibiting various properties potentially possessed by PTFE (such as water repellency, heat resistance, chemical resistance and sound permeability), and at the same time, due to the secondary fibers being nanofibers, exhibits properties possessed by nanofibers. Particularly when the secondary fibers have a fiber diameter close to being 100 nm, the fluororesin sheet when used for an air filter achieves a significantly high filtering performance.

In the fluororesin sheet used in the present invention, the primary fibers and the secondary fibers are integrated with each other, so that strength mainly attributed to the primary fibers and nanofiber properties mainly attributed to secondary fibers are simultaneously attained, and separation among the fibers hardly occur to provide increased conjugate stability.

The fluororesin sheet used in the present invention, in which the secondary fibers are randomly generated between the primary fibers randomly arranged, exhibits isotropic physical property. Meanwhile, by using a sheet containing primary fibers whose orientations are controlled, the sheet which exhibit anisotropic physical property can be produced. As such, it is possible to produce the sheet which is constant in its strength in all the directions, and it is also possible to produce the sheet which is superior in its strength only in a specific direction.

Since the hydrophilic sheet of the present invention has been made hydrophilic as a result of applying hydrophilization treatment to the above fluororesin sheet, the sheet can exert properties inherent in the fluororesin sheet not only as an air filter but also as a filter for liquid filtration without losing the properties.

According to the process for producing the hydrophilic sheet of the present invention, the fiber diameter of the secondary fibers being generated in the fluororesin sheet and their generation density are controllable by melting state of fiber-constituting resin and by stress in two directions (i.e., pressing direction with respect to the sheet, and direction perpendicular thereto). For instance, higher melting proportion of the resin leads to increase of the fiber diameter, and larger stress leads to increase of density of the fibers.

BRIEF DESCRIPTION OF DRAWINGS

FIG. 1 shows an image enlarged by SEM to a magnification of 1,000 of PTFE mat surface disclosed in Patent Document 1. FIG. 1 shows that only fibers having a fiber diameter of 500 nm or more are observed.

FIG. 2 shows an image enlarged by SEM to a magnification of 1,000 of a porous structure surface made of PTFE disclosed in Patent Document 5. FIG. 2 shows a large number of knots (nodes in the form of thick lumps), the knots being arranged in a certain direction.

FIG. 3 shows an image enlarged by SEM to a magnification of 5,000 of a surface of a fluororesin sheet obtained in Production Example 2. FIG. 3 shows the fluororesin sheet in which the secondary fibers are generated (shows a conjugate formed by primary fibers and by secondary fibers having a fiber diameter smaller than a fiber diameter of the primary fibers).

FIG. 4 shows a series of SEM images of fluororesin fiber sheets produced in Production Examples 1-3 and Comparative Production Examples 1 and 2, as described further herein in the Examples.

DESCRIPTION OF EMBODIMENTS

Hereinafter, the hydrophilic sheet of the present invention and its production process will be described in detail.

<Hydrophilic Sheet>

The hydrophilic sheet of the present invention is a sheet obtained by using fibers made of PTFE alone or fibers containing PTFE and a fluororesin different from PTFE (said fibers being defined as fluororesin fibers) and by undergoing specific steps (preferably through the production process of the present invention), wherein the surface of the fluororesin sheet comprising the fluororesin fibers which has undergone hydrophilization treatment has a hydrophilicity such that a water contact angle is 90° or less.

<<Fluororesin Sheet>>

The fluororesin sheet used in the present invention, for example as in FIG. 3 showing an image enlarged to a magnification of 5,000 for Example 2, is made of fluororesin fibers comprised the primary fibers and the secondary fibers having a fiber diameter smaller than a fiber diameter of the primary fibers, wherein the secondary fibers "crosslink" in each of the primary fibers and/or "crosslink" different primary fibers (the "crosslinking" can be expressed as "joining", differing from simple "contacting" and "entangling" embodiments, and can be likened to side chains bridging polymer chains), and crosslinking points are characterized by having no knots.

In the specification: fibers made of PTFE alone and fibers made of PTFE and a fluororesin different from PTFE are collectively referred to as the "fluororesin fibers"; an article formed into a sheet from said fluororesin fibers by conventionally known method is referred to as the "fluororesin fiber sheet"; a sheet obtained through specific steps using said fluororesin fiber sheet is referred to as the "fluororesin sheet" (i.e., the fluororesin sheet used in the present invention). In particular, the fluororesin fiber sheet wherein the fluororesin fibers are fibers made of PTFE alone is referred to also as the "fluororesin fiber sheet (a0)". A sheet obtained through specific steps using the fluororesin fiber sheet (a0) is referred to also as the "fluororesin sheet (a1)". On the other hand, the fluororesin fiber sheet wherein the fluororesin fibers are fibers containing both PTFE and a fluororesin different from PTFE is referred to also as the "fluororesin fiber sheet (b0)". A sheet obtained through specific steps using the fluororesin fiber sheet (b0) is referred to also as a "fluororesin sheet (b1)".

The fiber diameters of the primary fibers and of the secondary fibers in view of the secondary fibers being required to be thinner than the primary fibers as described above and further in view of properties such as strength, particle-capturing ability and stability are as follows. It is preferred that a fiber diameter of the primary fibers generally range from 100 nm to 50 μm and a fiber diameter of the secondary fibers generally range from 10 nm to less than 1 μm; it is more preferred that a fiber diameter of the primary fibers range from 500 nm to 1 μm and a fiber diameter of the secondary fibers range from 30 nm to 300 nm; and it is still more preferred that a fiber diameter of the secondary fibers range from 30 nm to 100 nm. In the specification, the reference to the "fiber diameter" is measured by using images obtained from SEM and means its average value. More specifically, in the fluororesin sheet for measurement, calculation of the average value is done by randomly selecting sections to be SEM observed, and then observing the sections by SEM (magnification: 10,000) to randomly select ten fluororesin fibers. The average value is the result of measurements carried out for these fluororesin fibers.

Particularly when the secondary fibers have a fiber diameter of not more than 300 nm, "slip flow effect", namely considerable reduction of air resistance, is exhibited, specific surface area is considerably increased, and moreover supermolecular arrangement effect is obtained. For these reasons, the fiber diameter falling within the above range is suited in the use of the hydrophilic sheet of the present invention, described later, for filters and the like.

The generation density of the secondary fibers on the sheet surface in view of properties such as strength and particle-capturing ability is preferably the number of the primary fibers: the number of the secondary fibers ranging from about 10:1 to 1:10. In the fluororesin sheet for measurement, calculation of the generation density is done by selecting sections to be SEM observed, and observing the sections (magnification: 5,000) by SEM to count the number of the primary fibers and the number of the secondary fibers based on the difference in diameters of the fibers.

The fibers, in addition to being PTFE, may be as follows: tetrafluoroethylene-perfluoroalkyl vinyl ether copolymer [PFA] (for example, "Dyneon PFA" (product name) manufactured by Sumitomo 3M Limited, "Fluon (registered trademark) PFA"(product name) manufactured by Asahi Glass Co., Ltd.), tetrafluoroethylene-hexafluoropropylene copolymer [FEP], tetrafluoroethylene-hexafluoropropylene-perfluoroalkyl vinyl ether copolymer [EPE], poly(chlorotrifluoroethylene) [PCTFE], tetrafluoroethylene-ethylene copolymer [ETFE], low melting point ethylene-tetrafluoroethylene copolymer, ethylene-chlorotrifluoroethylene copolymer [ECTFE], polyvinylidene fluoride [PVDF], fluoroethylene-vinyl ether copolymer [FEVE], tetrafluoroethylene-perfluorodioxole copolymer [TFEPD], which are defined as "other fluororesin(s)". One kind of the "other fluororesin(s)" may be contained, or alternatively two or more kinds thereof may be contained. Particularly from the viewpoints such as stability and durability, the fibers preferably consist only of PTFE (PTFE content: 100 wt %).

When the fibers are made of PTFE and the "other fluororesin(s)" different from PTFE, it is preferred that PTFE be contained at 50 wt % or more (provided that PTFE and the "other fluororesin(s)" total 100 wt %). If PTFE accounts for less than 50 wt %, a production process described later may permit the "other fluororesin(s)" while being heated to elute resulting in failing to form a sheet.

<<Hydrophilic Sheet>>

The hydrophilic sheet of the present invention is obtained by subjecting the above-identified fluororesin sheet to hydrophilization treatment, wherein its surface after hydrophilization treatment desirably has hydrophilicity and has as a wetting index a water contact angle of 90° or less, preferably 60° or less, more preferably 30° or less, still more preferably 10° or less, at which water having a large surface tension can be filtered with good efficiency.

In the present invention, the surface represents not just outermost surfaces of the hydrophilic sheet but also represents exposed surfaces including periphery of gaps (simply can be said as "pores" or "pore parts") formed between fibers (meaning the primary fibers and the secondary fibers) constituting the surface of the hydrophilic sheet.

The wetting index is determined by measuring a contact angle formed with water by liquid dropping method.

An example of the "hydrophilization treatment" used in the present invention is coating the fluororesin sheet (its partial surface or whole surface) with the "hydrophilic group-having compound".

The "hydrophilic group-having compound" is not particularly limited as long as being a compound that has a hydrophilic group and being not detrimental to the effects of the present invention. Examples thereof include hydroxyl group-containing compounds, carboxylic acid group-containing compounds, sulfonic acid group-containing compounds, ether group-containing compounds, epoxy group-containing compounds and amino group-containing compounds. These compounds may be used singly, or alternatively two or more kinds thereof may be used in combination.

The hydroxyl group-containing compounds, which are not particularly limited, include polyvinyl alcohol [PVA], polysaccharides such as agarose, dextran, chitosan and cellulose and their derivatives, collagen, gelatin, copolymers of vinyl alcohol and a vinyl group-containing monomer (for example, vinyl alcohol-vinyl acetate copolymers, ethylene-vinyl alcohol copolymers), acrylic polyols, fluorine-containing polyols, polyoxyalkylenes and polyester polyols.

The carboxylic acid group-containing compounds, which are not particularly limited, include olefin monomers such as ethylene, propylene and butylene; diene monomers such as butadiene; aromatic group-containing monomers such as styrene; copolymers formed by either one kind or two or more kinds of monomer(s) (i) selected from (meth)acrylic acid ester monomers such as acrylic acid esters and methacrylic acid esters and by a carboxylic acid group [—COOH]—having monomer (ii) such as acrylic acid and methacrylic acid; homopolymers of the carboxylic acid group-having monomer (ii) such as acrylic acid and methacrylic acid; and amino acids.

The sulfonic acid group-containing compounds, which are not particularly limited, include a copolymer of styrene and acrylamide-2-methylpropane sulfonic acid (salt); a ternary copolymer formed by styrene, n-butyl acrylate and acrylamide-2-methylpropane sulfonic acid (salt); and a ternary copolymer formed by styrene, 2-ethylhexyl acrylate and acrylamide-2-methylpropane sulfonic acid (salt).

The ether group-containing compounds, which are not particularly limited, include polyethylene glycol and its derivatives, ether group-having fluorine copolymers, ether group-having polyurethane resins, and ether group-having polyphenylene resins.

The epoxy group-containing compounds, which are not particularly limited, include epoxy resins, modified epoxy resins, epoxy group-having acrylic (co)polymer resins, epoxy group-having polybutadiene resins, epoxy group-having polyurethane resins, and adducts or condensates of these resins.

The amino group-containing compounds, which are not particularly limited, include polyethyleneimine, polyvinylamine, polyamide polyamine, polyamidine, polydimethyl aminoethyl methacrylate, and polydimethyl aminoethyl acrylate.

The weight average molecular weight [Mw] of these hydrophilic group-having compounds, which is not particularly limited, preferably ranges from about 100 to about 1,000,000.

Of these hydrophilic group-having compounds, because of containing much amount of a hydroxyl group, the hydroxyl group-containing compounds are preferred, and particularly polyvinyl alcohol [PVA] is more preferred.

The saponification degree of PVA, which is not particularly limited, preferably ranges from 50 to 100, more preferably ranges from 60 to 100. If its saponification degree is less than 50, the hydrophilic sheet may have insufficient hydrophilicity.

The weight average molecular weight of PVA, which is not particularly limited, preferably ranges from 200 to 150,000, more preferably from 500 to 100,000. If its molecular weight is less than 200, PVA may not be immobilized on the fluororesin sheet, possibly resulting in the loss of hydrophilicity. If its molecular weight exceeds 150,000, PVA may not permeate the fluororesin sheet, possibly failing to hydrophilize the inside of the sheet.

Commercially available products of PVA are, in addition to PVA used in Examples (manufactured by Wako Pure Chemical Industries, Ltd. saponification degree: 78 to 82), for example, RS2117 (molecular weight: 74,800), PVA103 (molecular weight: 13,200, saponification degree: 98 to 99), PVA-HC (saponification degree: not less than 99.85), PVA-205C (molecular weight: 22,000, high purity, saponification degree: 87 to 89), M-205 (molecular weight: 22,000, saponification degree: 87 to 89) and M-115 (molecular weight: 66,000, saponification degree: 97 to 98) (the products listed above are manufactured by Kuraray Co., Ltd.).

How to coat the exposed surfaces of the fluororesin sheet with the hydrophilic group-having compound will be described later.

<Process for Producing Hydrophilic Sheet>

A process for producing the hydrophilic sheet of the present invention preferably comprises steps (i) to (vi) described below, and is characterized in particularly containing a steps (iii), (v) and (vi).

In a step (i), fluororesin fibers (i.e., the primary fibers) are prepared by electrospinning method.

In a step (ii), the fluororesin fibers are formed into a sheet (namely, the fluororesin fiber sheet (a0) or (b0) is produced).

In a step (iii), which is referred to also as a secondary fiber formation step, in the sheet while being heated (for example, in an electric furnace), stress in at least two directions (preferably compressive stress, and shearing stress perpendicular to the compressive stress) is caused.

In a step (iv), cooling under the application of the pressures is carried out and thereafter the pressures are released, whereby the fluororesin sheet (a1) or (b1) is produced, in which the secondary fibers have been generated.

In the step (v), the fluororesin sheet obtained through the foregoing steps is immersed in a solution of the "hydrophilic group-having compound" whereby the fluororesin sheet is coated with the "hydrophilic group-having compound".

In a step (vi), the "hydrophilic group-having compound" having coated the fluororesin sheet obtained in the step (v) is crosslinked.

The steps (v) and (vi) are referred to also as hydrophilization steps, in particular.

In the present invention, an original sheet made of the primary fibers and having no secondary fibers is heated in a heating furnace (e.g., electric furnace) while load is being applied thereto in at least two directions (resulting in causing stress) as described above. It is believed that this causes melting partial resin on outside surfaces of the individual primary fibers (primary fiber-forming resins such as PTFE) as well as causing heat-fusion between outside surfaces of the neighbouring primary fibers, consequently widening gaps between the primary fibers by elastic restoring force of the sheet or of the primary fibers contained in the sheet; that this results in the formation of the secondary fibers, which connect one primary fiber with another primary fiber between neighbouring primary fiber surfaces, the secondary fibers stretching which is likened to stretching of threads of Natto, a Japanese food made from fermented soybeans; that the primary fiber surfaces and the secondary fibers at this state undergo the decrease of temperature to become solidified; and that as a result, the secondary fibers, which are thinner than the primary fibers, are formed as if to bridge the primary fibers.

In the present invention, force externally acting on the fluororesin sheet (external force) is defined as "load"; and when the load acts on the fluororesin sheet, internal force being resistant to said load and acting to establish balance within the sheet is defined as "stress". The stress is equal to the load, and their directions are opposite to each other.

As the electrospinning method carried out in the step (i), a method described for example in Patent Document 1(US-2010/0193999 A1) may be used.

As the method of forming the fluororesin fibers into a sheet in the step (ii), a method described for example in Patent Document 1 may be used.

In the step (iii), a temperature in an electric furnace that ensures heating conditions is as follows. For the fluororesin fiber sheet (a0), comprising fibers made of PTFE alone, the temperature preferably ranges from 180° C. to 400° C., more preferably from 270° C. to 380° C., still more preferably from 300° C. to 360° C. The compressive stress is caused by compressive load preferably ranging from 0.01 kg/cm$^2$ to 10 kg/cm$^2$, more preferably from 0.05 kg/cm$^2$ to 1 kg/cm$^2$. The temperature and the compressive load each falling within the above range are preferred in terms of enabling the secondary fibers with a uniform desired thickness to bridge the primary fibers, preventing nodes from occurring at crosslinking (bonding) positions between the primary fibers and the secondary fibers, and consequently achieving superior properties and performance described above.

Meanwhile, when the fluororesin fiber sheet (b0), made of fibers containing PTFE and a fluororesin different from PTFE, is to be used, a preferred temperature under the heating (e.g., in an electric furnace) is the one at which the thicker fibers (the primary fibers) undergo their melting only at their surfaces and do not lose their fiber-shape as a result of complete melting also in their insides, its example being generally from 150° C. to 360° C., and the compressive load ranges from 0.01 kg/cm$^2$ to 20 kg/cm$^2$. The temperature and the compressive load each falling within the respective ranges are preferred in terms of e.g., fiber-shape stability.

In the step (iii), the stress in at least two directions is caused, for example, by, while applying load to the fluororesin fiber sheet which is held between a pair of stainless plates (compressive load), horizontally moving the stainless plate (shearing load), or by holding the fluororesin sheet between two rolls differing in rotation speed (compressive load, shearing load) or the like; the present invention is not limited to these embodiments.

In the step (iii), i.e., the secondary fiber formation step, stress in at least two directions is caused (i.e., stress generation treatment) in the fluororesin fiber sheet while the fluororesin fiber sheet is heated (i.e., heating treatment). The heating treatment and the stress generation treatment may be conducted simultaneously or sequentially (i.e., the heating treatment may be followed by the stress generation treatment, or the stress generation treatment may be followed by the heating treatment). Particularly, when the heating treatment and the stress generation treatment are simultaneously conducted, it is preferred that after the heating treatment is conducted, the stress generation treatment be conducted, in terms of convenience and efficiency; and particularly, it is more preferred that the heating treatment and the stress generation treatment be simultaneously conducted.

In the case where the fluororesin sheet used in the present invention is made of PTFE alone, mechanism where the production process of the present invention generates the secondary fibers can be assumed in the following manners.

Mechanism 1): The primary fibers, having contacted with each other in the step (iii), are released from load applied thereto in the step (iv) to be separated from each other: at this time, parts of resin on surfaces of the primary fibers (for example, PTFE) are pulled while forming threads, which is likened to threads of "Natto" stretching, to form the secondary fibers. From the fact that the secondary fibers often exist as if to bridge the primary fibers (which is conspicuous when a few number of the secondary fibers exist), it is assumed that heating the fluororesin sheet made of PTFE alone close to a melting point of PTFE (327° C.) melts and gelates PTFE fiber surfaces and then releasing the pressures causes the primary fibers to be attached and detached from each other by elastic restoring force of the primary fibers, during which the gelated resins of the surfaces of the primary fibers are pulled by each other, so that the secondary fibers, which are fibrous more finely than the primary fibers, are formed.

Mechanism 2): When the primary fibers contact with each other in the step (iii), the primary fibers are torn or split to produce the secondary fibers. The PTFE primary fibers are originally made from an assemblage of spherical particles. The fluororesin fiber sheet made of PTFE alone, by being heated close to a melting point of PTFE, has come to have increased fiber fluidity and become easily separable into finer fibers by external force.

Mechanism 3): In the step (iii), preferably, the primary fibers undergo shear force to be formed into ultrafine fibers. It is known that application of shear force to PTFE leads to the formation of fibrils (for example, paragraph [0016] of JP-A-2004-154652). It is thus assumed that weak shear force, working during pressure release, leads to the formation of fibrils (secondary fibers) which are dissimilar to formed products seen in conventional documents.

In the step (v), the concentration of the "hydrophilic group-having compound" in its solution is 0.4 to 1.5 wt %, preferably 0.4 to 1.0 wt %. By the compound concentration falling within the above range, reduction of degree of hydrophilicity of the hydrophilic sheet and reduction of shape retentivity of the compound crosslinked are avoided, and furthermore, clogging of the pores of the hydrophilic sheet, and increase of volume change of the hydrophilic sheet at the time of immersion and drying are prevented.

A preferred solvent for the solution of the "hydrophilic group-having compound" is able to dissolve the "hydrophilic group-having compound" and is readily volatile. Specific examples, which are not particularly limited, are water; alcohols such as methyl alcohol, ethyl alcohol, n-propyl alcohol, isopropyl alcohol, n-butyl alcohol, sec-butyl alcohol, t-butyl alcohol and isobutyl alcohol; esters such as methyl acetate, ethyl acetate and butyl acetate; ketones such as acetone and methyl ethyl ketone; aromatic hydrocarbons such as toluene and xylene; and ethers such as diethyl ether, dibutyl ether, tetrahydrofuran and dioxane.

These solvents may be used singly, or alternatively two or more kinds thereof may be mixed and used. Of these, water is preferred, since the solubility of the "hydrophilic group-having compound" therein is higher.

In the step (v), time during which the fluororesin sheet is immersed in the solution of the "hydrophilic group-having compound" varies depending on a thickness of the fluororesin sheet and a temperature of the aqueous solution, but is able to be appropriately adjusted by one skilled in the art.

When the solution of the "hydrophilic group-having compound" is an aqueous solution in the step (v), even if the fluororesin sheet to which no treatment has been applied is immersed in the aqueous solution of the "hydrophilic group-having compound", the immersion cannot allow the "hydrophilic group-having compound" to permeate the fluororesin sheet to coat at least the surface of the fluororesin sheet (and preferably including vicinity of the surface of the sheet (i.e., exposed surface) or the inside of the sheet) with the hydrophilicity group-containing compound. It is therefore preferred that the fluororesin sheet is first immersed in a "solvent compatible with water" such as isopropyl alcohol. The reason why the fluororesin sheet to which no treatment has been applied cannot be coated directly with the aqueous solution of the "hydrophilic group-having compound" is high hydrophobicity of the fluororesin such as PTFE.

A preferred "solvent compatible with water" is readily permeating the fluororesin sheet and is readily volatile. Specific examples, which are not particularly limited, are alcohols such as methyl alcohol, ethyl alcohol, n-propyl alcohol, isopropyl alcohol, n-butyl alcohol, sec-butyl alcohol, t-butyl alcohol and isobutyl alcohol; esters such as methyl acetate, ethyl acetate and butyl acetate; ketones such as acetone and methyl ethyl ketone; aromatic hydrocarbons such as toluene and xylene; and ethers such as diethyl ether, dibutyl ether, tetrahydrofuran and dioxane.

These solvents may be used singly, or alternatively two or more kinds thereof may be mixed and used. Of these, isopropyl alcohol [IPA] is preferred, since it readily permeates the fluororesin sheet.

Time during which the fluororesin sheet is immersed in the "solvent compatible with water" varies depending on a thickness of the fluororesin sheet and a temperature of that solvent, but is able to be appropriately adjusted by one skilled in the art.

Methods of crosslinking the "hydrophilic group-having compound" carried out in the step (vi) are, for example, irradiation crosslinking using ionizing radiation such as electron ray, thermal crosslinking, and chemical crosslinking using a crosslinking agent. Of these crosslinking methods, chemical crosslinking using a crosslinking agent is preferred in terms of the certainty of crosslinking. When the "hydrophilic group-having compound" is PVA, the state of the fluororesin sheet immersed in and coated with PVA is highly stable in the aqueous solution at ordinary temperature. By contrast, thermal crosslinking, and irradiation crosslinking anaerobically carried out, are disadvantageous in that, for example, these methods disturb PVA adsorption state and reduce strength of PTFE itself. The chemical crosslinking, meanwhile, allows the crosslinking to be carried out even in the aqueous solution.

The crosslinking agent used in chemical crosslinking, which is not particularly limited, can be appropriately selected depending on a type of the "hydrophilic group-having compound" to be used. Examples thereof include aldehyde compounds such as formaldehyde, glutaraldehyde and terephthalaldehyde; ketone compounds such as diacetyl, chloropentanedione; reactive halogen-having compounds such as bis(2-chloroethylurea)-2-hydroxy-4,6-dichloro-1,3,5-triazine; reactive olefin-having compounds such as divinylsulfone; N-methylol compounds; isocyanates; aziridine compounds; carbodiimide compounds; epoxy compounds; halogen carboxylic aldehydes such as mucochloric acid; dioxane derivatives such as dihydroxydioxane; inorganic crosslinking agents such as chromium alum, zirconium sulfate, boric acid, boric acid salts, phosphoric acid salts; diazo compounds such as 1,1-bis(diazoacetyl)-2-phenylethane; compounds containing disuccinimidyl ester; and bifunctional maleic imide. These crosslinking agents may be used singly, or alternatively two or more kinds thereof may be used in combination.

Of these crosslinking agents, the crosslinking method which uses the aldehyde compound such as glutaraldehyde and terephthalaldehyde and which is carried out under an acid catalyst is particularly preferred because of providing high reactivity at ordinary temperature and achieving crosslinking amount stabilized at a certain amount as well as because of providing acetal bonds, being crosslinking points produced, which have a relatively high chemical resistance. A reaction formula under this method is shown below. The crosslinking using any of these aldehyde compounds is advantageous particularly for the production of the hydrophilic sheet also from the viewpoint that crosslinking is not affected by alcohols.

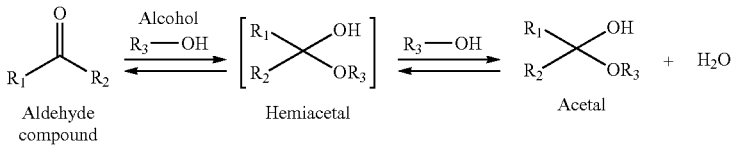

wherein $R_1$, $R_2$ and $R_3$ are each independently a specific functional group or atom.

<Applications of Hydrophilic Sheet>

The hydrophilic sheet of the present invention is suited for a filter for filtration/sterilization of gas and liquid. Specific filters include air filters, vent filters and filters for sterilization.

EXAMPLES

Next, the present invention will be described in greater detail with reference to Examples, but are not limited thereto.

Production Example 1

A fluororesin fiber sheet made of PTFE fibers prepared by conventional electrospinning method (length: 10 cm, width: 10 cm, thickness: 65.7 μm, weight: 18.6 mg, average fiber diameter: 1 μm) were held between a pair of stainless plates, and had a mold weighing 6 kg mounted thereon thereby applying a compressive load of 0.06 kg/cm$^2$ to the fluororesin fiber sheet, during which the fluororesin fiber sheet was kept in an electric furnace at 360° C. for 1 hour.

Subsequently, shearing load perpendicular to the compressive load was applied to the fluororesin fiber sheet. Specifically, with the lower part of the mold and the lower stainless plate being fixed, the upper part of the mold was moved together with the upper stainless plate by 2 mm with a hammer. Thereafter, the resultant sheet was cooled to room temperature. After the mold and the stainless plates were detached, a fluororesin sheet was obtained.

By using SEM (S-3400N (manufactured by Hitachi High-Technologies Corporation), a surface of the fluororesin sheet was observed (magnification: 5,000) to see whether secondary fibers are generated. Result thereof is shown in FIG. 4.

Production Example 2

Production Example 1 was repeated except that in Production Example 1, the weight of the mold was changed to 20 kg (=a compressive load of 0.20 kg/cm$^2$), to produce a fluororesin sheet. Then, whether the secondary fibers are generated was observed. Result thereof is shown in FIG. 4.

Production Example 3

Production Example 1 was repeated except that in Production Example 1, the weight of the mold was changed to 35 kg (=a compressive load of 0.35 kg/cm$^2$, to produce a fluororesin sheet. Then, whether the secondary fibers are generated was observed. Result thereof is shown in FIG. 4.

Comparative Production Example 1

Production Example 1 was repeated except that in Production Example 1, the mold was not mounted, to produce a fluororesin sheet. Then, whether the secondary fibers are generated was observed. Result thereof is shown in FIG. 4.

Comparative Production Example 2

The Production Example 3 was repeated except that in Production Example 3, shearing load was not applied, to produce a fluororesin sheet. Then, whether the secondary fibers are generated was observed. Result thereof is shown in FIG. 4.

With regard to the fluororesin sheets each obtained in Production Examples 2 and 3 and Comparative Production Examples 1 and 2, properties described below were evaluated.

(Thickness)

A thickness of the fluororesin sheet was measured with a micrometer LITEMATIC VL-50 (manufactured by Mitutoyo Corporation).

(Maximum Tensile Load/Tensile Strength)

Regarding a strength of the fluororesin sheet, tensile test was carried out using "EZ-test" manufactured by Shimadzu Corporation. Measurement method is as follows.

By using a microdumbbell, a dumbbell-type test piece with its central width being 5 mm was stamped out. Then, its width (measured by using calipers) and its thickness (measured by using "LITEMATIC VL-50A" manufactured by Mitutoyo Corporation) were precisely weighed.

The test piece was fixed to a tensile tester such that a length between its grips was 25 mm, and was pulled at a crosshead speed of 20 mm/min. Then, a maximum tensile load and a tensile strength when the test piece fractured were determined.

(Bubble Point Pore Diameter/Bubble Point Pressure)

A bubble point pore diameter represents a maximum pore diameter of the fluororesin sheet, and was calculated by bubble point method (ASTM F316-86). At the time of measurement, Galwick (15.9 dyn/cm) was used as an immersion liquid.

The fluororesin sheet well immersed in the liquid exhibits properties similar to those of capillary filled with liquid. By measuring a pressure which overcomes a liquid surface tension in the capillary to cause the liquid to be extruded out from its pore, a pore diameter can be calculated. Specifically, a point at which bubble is detected for the first time is defined as "bubble point=maximum pore diameter". A bubble point equation provided below is used to calculate a bubble point pore diameter d [m].

$$d=4\gamma \cos \theta/\Delta P$$

wherein θ is a contact angle between the fluororesin sheet and the liquid; γ [N/m] is a surface tension of the liquid, and ΔP is a bubble point pressure.

(Average Flow Rate Diameter/Average Flow Rate Diameter Pressure)

An average flow rate diameter was determined by half dry method defined in ASTM E1294-89. At the time of measurement, Galwick (15.9 dyn/cm) was used as immersion liquid.

In half dry method, determined first is a pressure to be given by a point at which a ventilation curve of the fluororesin sheet well immersed in the liquid, defined as a wet curve, intersects with a curve with an inclination half an inclination of a ventilation curve of a dry sample (a dry curve), defined as a half dry curve. The pressure is defined as an average flow rate diameter pressure. The pressure value determined is substituted in the bubble point equation. Thereby, an average flow rate diameter is determined.

Results thereof are shown in Table 2.

TABLE 2

Evaluation results of various properties

| Fluororesin sheet | | | Maximum | | Average flow rate | Average flow | Bubble | Bubble point |
|---|---|---|---|---|---|---|---|---|
| Type | Compressive load [kg/cm$^2$] | Thickness [μm] | tensile load [N] | Tensile strength [N/mm$^2$] | diameter pressure [psi] | rate diameter [μm] | point pressure [psi] | pore diameter [μm] |
| Production Example 2 | 0.20 | 38.5 | 0.70 | 6.7 | 3.47 | 1.88 | 2.08 | 3.14 |
| Production Example 3 | 0.35 | 38.4 | 0.78 | 7.5 | 4.62 | 1.41 | 2.54 | 2.57 |
| Comparative Production Example 1 | 0 | 65.7 | 0.53 | 2.8 | 2.57 | 2.54 | 1.60 | 4.07 |

(Evaluation of Particle-capturing Percentage)

As a particle-capturing percentage of the fluororesin sheet, a particle collection percentage in accordance with JIS B 9908 was measured. At this time, instead of a filter unit, the fluororesin sheets obtained in Production Example 3 and Comparative Production Examples 1 and 2 each having a size of 100 mm×100 mm were used. As dust for measurement, atmospheric dust (including dust with a particle diameter of 0.15 μm to 10 μm) was used. The flow rate of air was set at a face velocity of 14.8 cm/s.

Results thereof are shown in Table 3.

TABLE 3

Evaluation results of particle-capturing percentage

| Fluororesin sheet | | | Particle collection percentage for each particle diameter [%] | | | | |
|---|---|---|---|---|---|---|---|
| Type | Compressive load | Shearing load | 0.333 μm | 0.68 μm | 1.63 μm | 3.95 μm | 8 μm |
| Production Example 3 | + | + | 99.27 | 100 | 100 | 100 | 100 |
| Comparative Production Example 1 | − | + | 98.22 | 99.88 | 100 | 100 | 100 |
| Comparative Production Example 2 | + | − | 98.77 | 100 | 100 | 100 | 100 |

Range of diameters of particles to be observed
0.333 μm = 0.15 to 0.50 μm
0.68 μm = 0.50 to 1.0 μm
1.63 μm = 1.0 to 2.5 μm
3.95 μm = 2.5 to 6.0 μm
8 μm = 6.0 to 10 μm It is seen from FIG. 4 that in the fluororesin sheets obtained in Production Examples 1 to 3, the secondary fibers having a fiber diameter of not more than 100 nm (minimum fiber diameter is 40 nm, average: about 80 nm) generated between the primary fibers, and that the increase of the load led to the increased number of the secondary fibers. While the temperature in an electric furnace was set at 360° C. in Production Examples 1 to 3, it was confirmed that the secondary fibers ware generated even at 300° C. While the environment temperature in which load was applied in two directions was 360° C. in Production Examples 1 to 3, it was confirmed that the secondary fibers ware generated also when the load application was preceded by cooling to 180° C.

It is seen from Table 2 that load application treatment reduced the thickness, i.e., crushed fibers, resulting in the increase of membrane strength (tensile strength) with the tendency of reduction of pore diameter.

It is verified from Table 3 that the fluororesin sheet by having the secondary fibers generated therein had particularly improved ability to capture particles having a particle diameter of 0.333 μm (=0.15 to 0.50 μm), the capturing of which was considered to be difficult.

Example 1

The fluororesin sheet obtained in Production Example 1 was immersed at room temperature of 25° C. in a 99.7% isopropyl alcohol [IPA] solution (manufactured by Wako Pure Chemical Industries, Ltd.) for 1 minute.

Subsequently, the fluororesin sheet given after immersed in the IPA solution was immersed in 500 mL of an aqueous solution of polyvinyl alcohol [PVA] ("160-11485" manufactured by Wako Pure Chemical Industries, Ltd., polymerization degree: 1500, saponification degree: 98), adjusted to have a concentration of 0.5 wt %, at room temperature for 10 minutes.

Subsequently, the resultant fluororesin sheet was immersed in a solution prepared by adding 5 mL of hydrochloric acid 36% (manufactured by Wako Pure Chemical Industries, Ltd.) to 500 mL of a glutaraldehyde 5% solution (given by diluting a glutaraldehyde 25% solution manufactured by Wako Pure Chemical Industries, Ltd. with pure water to provide 5% solution) at room temperature for 60 minutes.

The resultant sheet was put in pure water, and boiled at 95° C. for 30 minutes to dissolve unreacted PVA, glutaraldehyde and IPA.

This was followed by natural drying. As a result, a hydrophilic fluororesin sheet having a water contact angle of 0° at its sheet surface was obtained.

(Evaluation of Water Contact Angle)

On a surface of the resultant hydrophilic fluororesin sheet, waterdrop was dropped and 10 seconds thereafter, a water contact angle was measured by using a contact angle measuring instrument (contact angle measuring instrument, CA-X type, manufactured by Kyowa Interface Science Co., Ltd.).

Examples 2 and 3

Example 1 was repeated except that in Example 1, the fluororesin sheet obtained in Production Example 1 was replaced by the fluororesin sheet obtained in Production Example 2 or Production Example 3 (in both the examples, the water contact angle at the surface was 135°) to apply hydrophilization treatment. Then, a water contact angle was measured. The water contact angle was 0° in Examples 2 and 3.

Comparative Example 1 0

Example 1 was repeated except that in Example 1, the hydrophilization treatment was not applied. Then, a water contact angle was measured. Namely, a water contact angle of the fluororesin sheet obtained in Production Example 1 was measured, and found to be 135°.

INDUSTRIAL APPLICABILITY

The fluororesin sheet used in the present invention prior to its hydrophilization treatment retains excellent properties derived from PTFE, such as water repellency, heat resistance, chemical resistance and sound permeability as well as has fibers with a significantly large specific surface area, and therefore the hydrophilic fluororesin sheet of the present invention given after its hydrophilization treatment is suited for precise filtration of gas and liquid and is widely applicable for example to filtration of e.g., corrosive gas and various gases used for example in semiconductor industry; filtration, sterilization and high-temperature filtration of washing water for electronic industry, water for medicine, water for drug production process and water for food; and filtration of reactive chemicals.

The invention claimed is:

1. A hydrophilic sheet obtained by applying hydrophilization treatment to a fluororesin sheet, wherein a surface of the hydrophilic sheet has hydrophilicity such that a water contact angle is 90° or less, and wherein the fluororesin sheet comprises primary fibers and secondary fibers having a smaller fiber diameter than a fiber diameter of the primary fibers, the secondary fibers crosslinking in each of the primary fibers and/or crosslinking between different primary fibers in such a manner that no knots are formed at crosslinking points, the primary fibers and the secondary fibers comprising fluororesin fibers that comprise polytetrafluoroethylene [PTFE], wherein the primary fibers have a fiber diameter of from 500 nm to 1 μm, and the secondary fibers have a fiber diameter of from 30 nm to 300 nm.

2. The hydrophilic sheet according to claim 1, wherein the fluororesin fibers comprise, in addition to PTFE, at least one kind of fluororesin selected from the group consisting of tetrafluoroethylene-perfluoroalkyl vinyl ether copolymer [PFA], tetrafluoroethylene-hexafluoropropylene copolymer [FEP], tetrafluoroethylene-hexafluoropropylene-perfluoroalkyl vinyl ether copolymer [EPE], poly(chlorotrifluoroethylene) [PCTFE], tetrafluoroethylene-ethylene copolymer [ETFE], low melting point ethylene-tetrafluoroethylene copolymer, ethylene-chlorotrifluoroethylene copolymer [ECTFE], polyvinylidene fluoride [PVDF], fluoroethylene-vinyl ether copolymer [FEVE] and tetrafluoroethylene-perfluorodioxole copolymer [TFEPD], the fluororesin(s) being contained at more than 0 wt % and less than 50 wt % provided that PTFE and the fluororesin(s) total 100 wt %.

3. The hydrophilic sheet according to claim 1, wherein the fluororesin fibers consist of PTFE.

4. The hydrophilic sheet according to claim 1, wherein the hydrophilization treatment is a coating treatment using a hydrophilic group-having compound.

5. The hydrophilic sheet according to claim 4, wherein the hydrophilic group-having compound is at least one compound selected from the group consisting of hydroxyl group-containing compounds, carboxylic acid group-containing compounds, sulfonic acid group-containing compounds, ether group-containing compounds, epoxy group containing compounds and amino group-containing compounds.

6. The hydrophilic sheet according to claim 4, wherein the hydrophilic group-having compound is polyvinyl alcohol [PVA].

7. The hydrophilic sheet according to claim 2, wherein the hydrophilization treatment is a coating treatment using a hydrophilic group-having compound.

8. The hydrophilic sheet according to claim 3, wherein the hydrophilization treatment is a coating treatment using a hydrophilic group-having compound.

9. The hydrophilic sheet according to claim 5, wherein the hydrophilic group-having compound is polyvinyl alcohol [PVA].

10. A process for producing the hydrophilic sheet according to claim 1 comprising:

a secondary fiber formation step of causing stress in at least two directions in a fluororesin fiber sheet made of fluororesin fibers while heating the sheet to form the secondary fibers thereby obtaining a fluororesin sheet; and a hydrophilization step of applying hydrophilization treatment to a surface of the fluororesin sheet to obtain the hydrophilic sheet.

11. The process for producing the hydrophilic sheet according to claim 10, wherein the fluororesin fiber sheet is a fluororesin fiber sheet formed into a sheet from fluororesin fibers, the fluororesin fibers being prepared by electrospinning method, a temperature of the heating ranges from 180° C. to 400° C., and the stress is caused by applying compressive load ranging from 0.01 $kg/cm^2$ to 10 $kg/cm^2$ and shearing load.

12. The process for producing the hydrophilic sheet according to claim 11, wherein the temperature of the heating ranges from 300° C. to 360° C., and the stress is caused by applying compressive load ranging from 0.05 $kg/cm^2$ to 1 $kg/cm^2$ and shearing load.

13. The process for producing the hydrophilic sheet according to claim 10, wherein the hydrophilization step comprises:

a step (v) of immersing the fluororesin sheet in a solution of the hydrophilic group-having compound to coat the fluororesin sheet with the compound, and a step (vi) of crosslinking the compound having coated the fluororesin sheet obtained in the step (v).

14. The process for producing the hydrophilic sheet according to claim 11, wherein the hydrophilization step comprises:

a step (v) of immersing the fluororesin sheet in a solution of the hydrophilic group-having compound to coat the fluororesin sheet with the compound, and a step (vi) of crosslinking the compound having coated the fluororesin sheet obtained in the step (v).

15. The process for producing the hydrophilic sheet according to claim 12, wherein the hydrophilization step comprises:

a step (v) of immersing the fluororesin sheet in a solution of the hydrophilic group-having compound to coat the fluororesin sheet with the compound, and a step (vi) of crosslinking the compound having coated the fluororesin sheet obtained in the step (v).

* * * * *